US007160581B2

(12) United States Patent
Gilles et al.

(10) Patent No.: US 7,160,581 B2
(45) Date of Patent: Jan. 9, 2007

(54) PREPARATION OF STEEL SURFACES FOR SINGLE-DIP ALUMINIUM-RICH ZINC GALVANISING

(75) Inventors: Michael Gilles, Olen (BE); David Leychkis, Pittsburg, PA (US); Yume Grot, Pittsburg, PA (US); Roger Pankert, Olen (BE)

(73) Assignee: Umicore (BE)

( * ) Notice: Subject to any disclaimer, the term of this patent is extended or adjusted under 35 U.S.C. 154(b) by 21 days.

(21) Appl. No.: 10/501,107

(22) PCT Filed: Nov. 20, 2002

(86) PCT No.: PCT/EP02/13329

§ 371 (c)(1),
(2), (4) Date: Jul. 8, 2004

(87) PCT Pub. No.: WO03/057940

PCT Pub. Date: Jul. 17, 2003

(65) Prior Publication Data

US 2005/0069653 A1 Mar. 31, 2005

(30) Foreign Application Priority Data

Jan. 10, 2002 (EP) ..... 02075073

(51) Int. Cl.
*B05D 1/18* (2006.01)

(52) U.S. Cl. ..... 427/433; 427/310; 427/329; 427/406

(58) Field of Classification Search ..... 427/433, 427/310, 328, 329, 405, 406
See application file for complete search history.

(56) References Cited

U.S. PATENT DOCUMENTS

| | | | | |
|---|---|---|---|---|
| 3,457,097 A | | 7/1969 | Yonezaki et al. | |
| 4,505,958 A | | 3/1985 | Lieber et al. | |
| 4,713,153 A | * | 12/1987 | Adriaensen et al. | 205/711 |
| 5,160,552 A | * | 11/1992 | Tomita et al. | 148/277 |
| 5,437,738 A | | 8/1995 | Gerenrot et al. | |
| 6,009,912 A | * | 1/2000 | Andre | 138/143 |
| 6,200,636 B1 | * | 3/2001 | van Ooij et al. | 427/313 |

FOREIGN PATENT DOCUMENTS

| | | |
|---|---|---|
| CA | 1241572 | 9/1988 |
| GB | 483672 | 4/1938 |
| GB | 499149 | 1/1939 |
| GB | 896866 | 5/1962 |
| JP | 58 136759 | 8/1983 |
| JP | 02 185958 | 7/1990 |
| JP | 04 026748 | 1/1992 |
| JP | 04 026749 | 1/1992 |
| JP | 04 154951 | 5/1992 |
| JP | 2001049414 | 2/2001 |

OTHER PUBLICATIONS

Claessens, S. et al., "Influence of surface composition and morphology on the galvanizing behaviour of hot-rolled steel", Galvatech '2001, International Conference on Zinc and Zinc Alloy Coated Steel Sheet, Jun. 26-28, 2001, pp. 631-638, Publisher: Verlag Stahleisen GmbH, Dusseldorf, Germany.

* cited by examiner

*Primary Examiner*—Alain L. Bashore
(74) *Attorney, Agent, or Firm*—Hutchison Law Group PLLC

(57) ABSTRACT

A process is disclosed for the preparation of a steel surface for single-dip aluminium-rich zinc galvanizing. The process steps comprise: cleaning the surface so as to obtain less than 0.6 $\mu g/cm^2$ residual dirt; pickling the surface; applying a protective layer to the surface by immersion in a flux solution comprising bismuth. This invention also relates to a continuous steel product coated with a layer of metallic bismuth.

16 Claims, No Drawings

PREPARATION OF STEEL SURFACES FOR SINGLE-DIP ALUMINIUM-RICH ZINC GALVANISING

The present invention relates to a process for hot-dip galvanising of metals and steel in particular. It relates more specifically to the operations of cleaning, pickling and fluxing of the surface to be coated. The treated surfaces can then be galvanised by single immersion in a molten zinc-based bath which may contain high concentrations of aluminium, such as e.g. a Galfan bath. The process is especially suited for the galvanisation of continuous products such as steel wire, tube or sheet. This invention also relates to continuous steel product coated with a metallic layer consisting of bismuth.

Aluminium-rich alloys such as Galfan, which mainly consists of 95 wt % zinc and 5 wt % aluminium, impart higher corrosion protection to steel, improve its formability as well as its paintability compared to traditional hot-dip zinc alloys.

Though aluminium-rich alloys were developed more than twenty years ago, their application for the coating of continuous products such as wires, tubes and sheets can only be performed by a limited number or rather sophisticated and relatively expensive processes. These processes are the double-dip process whereby regular galvanising precedes Galfan coating, the electrofluxing process whereby electroplating by a thin zinc layer precedes Galfan coating, and the hot process whereby a furnace with a reducing atmosphere is used before Galfan application. Numerous attempts to apply Galfan by the traditional and more affordable Cook-Norteman flux process on continuous lines, have failed.

Considering the popularity of flux galvanising and its relatively low manufacturing cost, it seems very attractive to modify it in such a way that Galfan coating would become possible on continuous lines as well as in batch operations.

The presence of aluminium and the absence of lead makes the Galfan coating process extremely sensitive to many common shortcomings of traditional galvanising, like insufficient cleaning and pickling, absence of flux drying and preheating, when cold and sometimes wet parts are immersed in molten zinc.

Aluminium creates three main technological problems, which complicate the galvanising process:

- moisture or iron oxides on the steel surface reacts with molten aluminium and creates aluminium oxides, which are not wetted by molten zinc, according to the following reactions:

$$3H_2O+2Al>3H_2+Al_2O_3$$

$$3FeO+2Al>3Fe+Al_2O_3$$

$$3Fe_3O_4+8Al>9Fe+4Al_2O_3$$

- a thin layer of zinc-aluminium oxides on the surface of molten bath unavoidably contacts the steel in the dipping area and degrades its wetting by molten zinc;
- the aluminium present in the molten zinc reacts with the flux and consequently deteriorates its effectiveness according to the reactions:

$$3ZnCl_2+2Al>3Zn+2AlCl_3$$

$$6NH_4Cl+2Al>2AlCl_3+6NH_3+3H_2.$$

These peculiar features of galvanising in the presence of aluminium create unsatisfactory coatings with bare spots, pinholes and surface roughness.

It is thus an aim of this invention to alleviate the problems as described above.

To this end, a process is disclosed for the preparation of a steel surface for single-dip aluminium-rich zinc galvanising comprising the steps of cleaning the surface by either one of electrocleaning, ultrasonic cleaning and brush cleaning to a level of less than 0.6 $\mu g/cm^2$ residual dirt, pickling the surface, and applying a protective layer to the surface by immersion in a flux solution comprising bismuth. When using electrocleaning, at least 25 $C/dm^2$ can be passed through the steel surface. The pickling can be performed by either one of electropickling, ultrasonic pickling and ion exchange pickling using an Fe(III) chloride solution. The bismuth-bearing flux solution is prepared by using a soluble bismuth compound such as an oxide, a chloride or a hydroxychloride. It may contain between 0.3 and 2 wt % of bismuth, and, optionally, at least 7 wt % $NH_4Cl$ and 15 to 35 wt % $ZnCl_2$. The preferred $NH_4Cl$ content is between 8 and 12 wt %. The molten zinc bath may contain at least 0.15% aluminium, and, preferentially, 2 to 8% aluminium. The bath may also consist of Galfan alloy. The steel may be in the form of a continuous product, such as wire, tube or plate.

It appears that the Galfan fluxing process demands for an extremely clean steel surface, ensuring total absence of water breaks. If the soil concentration on the steel surface is too large, single-dip Galfan coating will not give good results. It was discovered that residual soil on the steel surface should not exceed 0.6 $\mu g/cm^2$, and preferably be less than 0.2 $\mu g/cm^2$. This soil level guarantees absence of water breaks on the surface while rinsing, and is in fact commonly requested and achieved when subsequent electroplating is envisaged.

It was established that for successful single dip Galfan coating using the traditional flux process, the same surface cleanliness is a necessity. To achieve the required cleanliness, three possible methods of treatment are available: electrocleaning, ultrasonic cleaning and brush cleaning.

All three methods were tested on 5 mm low carbon steel wire and on 6.1 mm high carbon steel wire.

Electrocleaning was performed with 1 to 4 anodic-cathodic cycles, the time period of one cycle being 0.6 sec. Regular current densities of 10 $A/dm^2$ and high densities of 50 to 100 $A/dm^2$ were tested. To achieve the desired level of cleanliness, not less than 25 $C/dm^2$ should pass through the surface. The cleaning solution contained 8 to 10% of FERROTECH CIL-2 cleaner (manufactured by Ferrotech, Pa., USA), consisting of (in wt %): 79.0 sodium hydroxide (50% solution), 1.1 sodium carbonate, 5.0 sodium tripolyphosphate, 2.5 surfactant package, and balance water. The solution temperature was 85° C. A relatively high amount of cleaner in the working solution is necessary to obtain high electrical conductivity.

Good cleaning was observed for a current density of 10 $A/dm^2$ after four 0.6 sec. cycles, and for a current density 50 $A/dm^2$ after one 0.6 sec. cycle.

Ultrasonic cleaning was performed with a circular transducer at a frequency of 20 kHz, and a specific power of 1 to 3 $W/cm^2$. The cleaning solution was at 80 to 85° C. and contained 5% of FERROTECH CIL-5 cleaner consisting of (in wt %) 4.0 tripotassium phosphate, 8.0 trisodium phosphate, 16.0 Petro AA (Witco), 4.5 other surfactants, and balance water. A clean surface was obtained in 1 to 2 sec.

Mechanical brush cleaning was performed at the same temperature and cleaning solution using a tough toothbrush. Energetic hand cleaning for 5 sec. per 25 cm wire length made samples totally fit for further treatment.

It may be concluded that any of described procedures can be used for wire cleaning depending of existing equipment on real life line.

Samples which were not properly cleaned (with an amount of soil corresponding to 1 to 2 μg/cm$^2$) and which therefore had water breaks on the surface demonstrated pinholes in Galfan coatings and bad adhesion after treatment with a Bi containing flux.

The cleaning procedure time depends on the amount of soil on the steel surface and the cleaning method used. This is illustrated in Table 1.

TABLE 1 cleaning time necessary and cleaning method as a function of the amount of soil

| Cleaning | Soil amount (μg/cm$^2$) | | |
|---|---|---|---|
| Time | Up to 10 | 20 to 30 | 50 to 100 |
| 1 to 2 min. | Soak | Soak with agitation | Soak with agitation or sprays |
| 3 to 5 sec. | Scrubbing by brushes or high pressure sprays | Electrocleaning with scrubbing | Electrocleaning with scrubbing |
| 1 to 2 sec. | Electrocleaning or ultrasonics | Electrocleaning with scrubbing | Precleaning, electrocleaning with scrubbing |
| 0.3 to 0.6 sec. | HCD(*) electrocleaning | HCD electrocleaning plus scrubbing | Precleaning, HCD electrocleaning with scrubbing |

(*)HCD: high current density electrocleaning (50 to 100 A/dm$^2$)

After cleaning, wire samples were pickled in hydrochloric acid (18.5% solution) at room temperature for 5 sec. After rinsing, fluxing and preheating, samples were coated with Galfan. The coating had bare spots, pinholes and substantial roughness.

Increasing pickling time reduced the number of coating defects. The Galfan coating became very good after 10 min. pickling. As far as this time period of pickling is totally unacceptable for industrial line, three other methods were tested: electropickling, ultrasonic pickling and ion exchange pickling.

Electropickling was performed in the HCl solution described above with anodic current densities of 10 A/dm$^2$ for 3 to 5 sec. and 50 A/dm$^2$ for 0.5 to 1 sec. In both cases, Galfan coating was smooth, uniform and without defects.

The same good results were observed after ultrasonic pickling for 5 sec. in the above-mentioned equipment used for the ultrasonic cleaning and using the HCl solution described above.

Finally, a special pickling method was proposed. When steel is dissolved in hydrochloric acid, iron enters the solution as ferrous divalent cation $Fe^{2+}$. The electrode potential of this reaction $Fe^{2+}/Fe$ by standard hydrogen electrode is −0.44 V. At the same time trivalent ferric cation $Fe^{3+}$ can be reduced to metal iron at +0.33 V. So, if in acid solution, which contains $Fe^{3+}$, a steel sample is immersed, two reactions take place:

metal iron is dissolved and creates ferrous cation $Fe^{2+}$ $$Fe^0-2e>Fe^{2+};\text{ and}$$

ferric iron $Fe^{3+}$ is reduced to metal iron $$Fe^{3+}+3e>Fe^0.$$

For every 3 created ferrous ions 2 ferric ions become metallic. The reaction is very rapid, because its electromotive force is high:

$$E=E(Fe/Fe^{3+})-E(Fe/Fe^{2+})=0.33\text{ V}-(-0.44\text{ V})=0.77\text{ V}$$

As a result, the concentration of ferric ion in the pickling solution gradually drops, while the amount of ferrous ion proportionally increases. To keep the solution in equilibrium, the ferrous ions have to be oxidised, which can be done with any oxidiser or which can happen naturally by air oxygen.

The described phenomewas used in an accelerated pickling procedure: wire from low and high carbon steel was pickled in 18.5% HCl solution for 3 to 5 sec., rinsed and immersed for 3 to 5 sec. in 10% $FeCl_3$ solution at 50° C. The sample surface became uniformly grey. The wire samples were then rinsed, fluxed, dried and preheated, and were then easily coated by Galfan without any defects.

A good fluxing agent for Galfan should be able:

- to create a thin protective metallic layer on the steel surface without applying electricity (no electroplating);
- to protect this layer and steel substrate from oxidation during drying/heating;
- to be easily removable from steel surface in molten Galfan.

In regular galvanising, ammonium chloride is present in the flux, and fulfils two functions, one of them being the reduction of iron oxides and the other one the flux removal from the steel surface by generating an energetic gaseous torrent through the molten zinc. In a Galfan coating process the first function is almost nullified because of the strong aluminium affinity to chlorine. The opinion was established that specifically the $AlCl_3$ formed deteriorates the Galfan coating, thereby creating pinholes and uncoated spots. So, the idea of reducing $NH_4Cl$ level in the flux to improve the coating quality was quite natural. As the function of flux removal remains very important, and this particularly on continuous lines, the $NH_4Cl$ level however cannot be reduced too much. That is why, in order to find an adequate flux formulation for Galfan, it was necessary to find out in what the optimum $NH_4Cl$ level in the flux is.

Three aqueous fluxes with 25 wt % $ZnCl_2$ and 1, 5 and 10 wt % $NH_4Cl$ were tested. The aluminium content in a bath with High Grade Zinc (containing 0.03 wt % Pb) was gradually increased from 0 up to 1.8 wt %. At higher aluminium content it was impossible to obtain a good coating with these traditional fluxes, because the first $NH_4Cl$ function was dramatically weakened. Steel panels measuring 1.5×40×100 mm were cleaned and pickled as described before, then fluxed with a flux without bismuth for 1 minute at 70 to 75° C. The panels were dried in an electrical furnace at 200° C. for 2 min. The zinc bath temperature was 450 to 455° C., and the immersion time was 2 min. Before withdrawal from bath, panels were vigorously moved up and down to remove flux remnants. The experimental results are presented in Table 2.

TABLE 2

Coating quality as a function of flux and bath composition

| Flux composition (wt %) | | Aluminium in bath (wt %) | | | | | | |
|---|---|---|---|---|---|---|---|---|
| $ZnCl_2$ | $NH_4Cl$ | 0.1 | 0.2 | 0.5 | 1.0 | 1.5 | 1.8 | ≧2 |
| 25.0 | 1.0 | G(*) | P(*) | P | P | P | P | P |
| 25.0 | 5.0 | G | G | P | P | P | P | P |
| 25.0 | ≧10.0 | G | G | G | G | G | G | P |

(*)G: Good P: Pinholes

It can be seen from Table 2, that up to 0.1% Al smooth, shiny coatings without pinholes can be obtained at all levels of $NH_4Cl$ in the flux. However, the higher the aluminium content of the bath, the more $NH_4Cl$ is needed to achieve a good coating. With 10 wt % $NH_4Cl$ in the flux, perfect coatings can be obtained up to at least 1.8% Al.

It was found out that the amount of gaseous $AlCl_3$ while galvanising with 1.8% Al in the bath is practically the same as when Galfan is used. Therefore the conclusion can be drawn, that the optimum $NH_4Cl$ content in the flux is between 8 and 12 wt %, preferably around 10 wt % $NH_4Cl$. This was confirmed when a flux for Galfan was formulated.

It was shown above that variations of $ZnCl_2$ and $NH_4Cl$ in conventional fluxes would not guarantee good Galfan coatings. At the same time thin layers of other metals are known to be very beneficial, as with zinc electroplating. That is why the chemical deposition of different metals from wat water solutions on iron (steel) has been thoroughly investigated in the fluxing application. The process, also referred to as ion exchange or cementation, consists of dissolving iron (by oxidation) and precipitation on its surface the other metal (by reduction), which has a more positive standard electrode potential, than iron. Thermodynamically, the ion exchange process becomes possible when the difference of standard electrode potentials (electromotive force) of the depositing metal M and iron is positive:

$$E=E(M/M^{n+})-E(Fe/Fe^{2+})>0.$$

In this case iron serves as anode, dissolves and its atoms become cations $Fe^{2+}$, while more positive metal cations $M^{n+}$ are reduced and become metal M. The commercially feasible metals like tin, nickel, antimony, iron, copper and bismuth meet this requirement, but not zinc.

In several experiments wire samples 85 to 100 mm long, with a diameter of 5.15 mm (low carbon steel), or 6 mm (high carbon steel) were used for determining a flux composition enabling a good Galfan coating. Surface preparation—cleaning, pickling and rinsing—was performed as described previously. After the flux treatment the samples were dried in an electrical furnace at 300 to 320° C. for 2 to 5 min. with a temperature at the wire surface in the range of 130 to 250° C. The Galfan bath was run at 440 to 460° C., the time in the molten metal was 3 to 6 sec. Before withdrawal, the samples were energetically moved up and down twice to remove flux remnants.

A first flux with copper contained (in wt %): $ZnCl_2$—25; $NH_4Cl$—9; $CuCl_2$—1.5; HCl—0.1; Merpol A (wetting agent)—0.02. The pH was 0.8 and the fluxing temperature was around 25° C. The residence time in the flux was 3 to 5 sec.

A further flux with nickel contained (in wt %): $ZnCl_2$—25; $NH_4Cl$—9; $NiCl_2$—2; HCl—0.04; Merpol A—0.02, it had a pH of 2.0 and the flux bath temperature was 70 to 75° C. The residence time in the flux was 1.5–2 min.

A flux with iron contained (in wt %): $ZnCl_2$—25; $NH_4Cl$—9; $FeCl_3$—8; HCl—2; Merpol A—0.02, it had a pH of 2.0 and the flux bath temperature was 70 to 75° C. The residence time in the flux was 1 to 1.5 min.

A flux with tin contained (in wt %): $ZnCl_2$—25 to 30; $NH_4Cl$—8 to 12; $SnCl_2$—2 to 3; HCl—3.5 to 4; wetting agent—0.04. The flux had a pH of 0, the temperature was maintained at 75 to 80° C., and the time in the flux was 2 to 3 min. for a batch and 3 to 6 sec. for a continuous line.

After fluxing, the samples were heated at 100 to 200° C. and coated in a Galfan bath. In the laboratory test it was important that all steel samples move through the molten Galfan and exit in the direction of the wire axis, like on a real-life line.

All the samples had smooth and shiny coatings, but except for the test samples treated with tin fluxes, they also had pinholes and 3 to 5% of uncoated small (1 to 2 mm) spots.

Further improvements of the flux with copper were investigated, because the high speed of copper deposition on steel makes it very attractive for wire lines. A flux with copper and tin chlorides was tested which contained (in wt %): $ZnCl_2$—25; $NH_4Cl$—10; $CuCl_2$—0.5; $SnCl_2$—1—3; HCl—4; Merpol A—0.02. The pH was 0.15 and the flux temperature around 25° C. It was earlier discovered in our investigations, that copper and tin co-deposit simultaneously on steel, creating copper-tin alloy-bronze of varying composition. In certain conditions (high $SnCl_2/CuCl_2$ ratio), yellow-gold bronze with 18% Sn can be deposited. However, it was found that bronze deposition provides no improvement in the quality of Galfan coating compared to copper.

In the experiments with the tin containing flux, the Galfan coating was very good, shiny and without any defects. However, besides the fact that tin contaminates the zinc bath, tin cementation is too slow (e.g. for wire applications) and the presence of tin promotes intergranular corrosion of the Galfan coating.

An experiment was carried out with an antimony containing flux with the following composition (in wt %): $ZnCl_2$—25; $NH_4Cl$—10; $Sb_2O_3$—0.7; Merpol HCS—0.02. The pH was 0.1. The results with a traditional galvanising bath were very good, but it was found that molten Galfan does not wet wire samples being coated with a thin layer of Sb.

In experiments with Bi fluxes, due to the high electromotive force of the Fe/Bi couple, the bismuth deposition proceeds at very high speed. 3 to 5 sec. at ambient temperature suffice to create a dark grey or black protective layer on the steel surface. Two flux formulations, with a composition as given in Table 3 demonstrated the best results.

TABLE 3

Flux formulations demonstrating the best galvanisation results

| Component (wt %) | Example 1 | Example 2 |
|---|---|---|
| $ZnCl_2$ | 25.0 | 0.0 |
| $NH_4Cl$ | 10.0 | 9.0 |
| HCl | 2.0 | 2.0 |
| BiOHCl | 1.0 | 0.0 |
| $Bi_2O_3$ | 0.0 | 1.0 |
| Glycerine | 0.0 | 1.0 |
| Merpol HCS | 0.02 | 0.02 |
| $H_2O$ | Balance | Balance |
| pH | 0.1–0.3 | 0.8–0.9 |

In these fluxes, $Bi_2O_3$ and BiOHCl are interchangeable. Any other soluble Bi compound can be added to the flux, in an amount suitable to form a continuous metallic film on the steel surface upon fluxing. On the steel surface, $Bi^{3+}$ is reduced to Bi and partially to $Bi^{2+}$, creating a metal coating and the deposition of $BiCl_2$ of black colour. Higher flux temperatures (around 40° C.) and prolonged exposure times do not substantially increase the thickness of the bismuth layer, but promote ample precipitation of $BiCl_2$. In these circumstances, the flux becomes needlessly exhausted. The flux in Example 2 cannot be used at high heating temperatures as $NH_4Cl$ starts to evaporate excessively upon heating.

The Galfan coatings applied after fluxing and heating to 140 to 230° C. were very smooth, shiny and without any defects like pinholes or bare spots.

Using the flux from Example 1 above, wire samples of low and high carbon steel were coated with Galfan at 450 to 455° C. with immersion times of 3 to 5 sec. Three samples were galvanised for each kind of steel and coating thickness was averaged after 10 measurements. Galfan coating thickness for low carbon steel was 8 μm, for high carbon 12 μm.

The influence of the bath temperature on Galfan coating thickness was investigated. The galvanising was performed at 510, 530 and 550° C. with immersion times of 5 sec., 1 min. and 2 min. The results of this experiment are presented in Table 4.

TABLE 4

Coating thickness as a function of steel type, immersion time and bath temperature

| Bath temperature | Coating thickness (μm) | | | | | |
|---|---|---|---|---|---|---|
| | Low carbon steel (0.01 wt % C) Immersion time | | | High carbon steel (0.4 wt % C) Immersion time | | |
| (° C.) | 5 sec. | 1 min. | 2 min. | 5 sec. | 1 min. | 2 min. |
| 450 | 8 | 12 | 14 | 12 | 12 | 13 |
| 510 | 14 | 20 | 33 | 12 | 16 | 15 |
| 530 | 44 | 78 | 180 | 14 | 15 | 22 |
| 550 | 28 | 49 | 150 | 14 | 15 | 15 |

The coating thickness on high carbon steel wire does not increase substantially with elevating bath temperature. At the same time, for low carbon steel it can increase by more than 5 times for 5 sec. Still, the coating obtained at 530 to 550° C. is very rough, which is caused by Fe—Al—Zn dendrites. At wire bending on 180°, there was no coating peeling or cracking.

In all experiments it was noticed that whenever the proper surface cleaning had not taken place, as mentioned before, the coating quality was severely deteriorated by the presence of pinholes and bad coating adhesion. The conclusions of all of the experiments is that only the combination of proper cleaning procedures and the use of a bismuth containing flux guarantees that the coatings obtained in a single dip Galfan bath are of excellent quality.

The invention claimed is:

1. A process for the preparation of a steel surface for hot-dip galvanising in a zinc based molten bath, comprising the steps of:

cleaning the surface by electrocleaning, ultrasonic cleaning, or brush cleaning, pickling the surface, and applying a protective layer to the surface by immersion in a flux solution, wherein the cleaning is performed to a level of less than 0.6 μg/cm$^2$ residual dirt, and the flux solution comprises a soluble bismuth compound.

2. The process of claim 1, wherein the cleaning is performed by electrocleaning, whereby at least 25 C/dm$^2$ passed through the steel surface.

3. The process of claim 1, wherein the pickling is performed by electropickling, ultrasonic pickling, or ion exchange pickling using an Fe (III) chloride solution.

4. The process of claim 1, wherein the soluble bismuth compound is an oxide, a chloride, or a hydroxychloride.

5. The process of claim 1, wherein the flux is an aqueous solution comprising between 0.3 and 2 wt % of bismuth.

6. The process of claim 1, wherein the flux solution further comprises at least 7 wt % of $NH_4Cl$.

7. The process of claim 6, wherein the flux solution comprises between 8 and 12 wt % of $NH_4Cl$.

8. The process of claim 6, wherein the flux solution further comprises between 15 and 35 wt % of $ZnCl_2$.

9. A process for single-dip galvanising of a steel surface using an aluminium containing molten zinc bath, comprising the steps of:

cleaning the surface by electrocleaning, ultrasonic cleaning, or brush cleaning, pickling the surface, applying a protective layer to the surface by immersion in a flux solution, and galvanising the surface by single-dipping the surface in an aluminium containing molten zinc bath, wherein the cleaning is performed to a level of less than 0.6 μg/cm$^2$ residual dirt, and the flux solution comprises a soluble bismuth compound.

10. The process of claim 9, wherein the aluminium containing zinc bath contains at least 0.15 wt % aluminium.

11. The process of claim 9, wherein the aluminium containing zinc bath contains between 2 and 8 wt % aluminium.

12. The process of claim 10, wherein the aluminium containing zinc bath is a Galfan bath.

13. The process of claim 1, wherein the steel is in the form of a continuous product.

14. The process of claim 9, wherein the steel is in the form of a continuous product.

15. The process of claim 13, wherein the continuous product is steel wire, tube or plate.

16. The process of claim 14, wherein the continuous product is steel wire, tube or plate.

* * * * *

UNITED STATES PATENT AND TRADEMARK OFFICE

CERTIFICATE OF CORRECTION

PATENT NO. : 7,160,581 B2
APPLICATION NO. : 10/501107
DATED : January 9, 2007
INVENTOR(S) : Michael Gilles et al.

It is certified that error appears in the above-identified patent and that said Letters Patent is hereby corrected as shown below:

Column 8, line 6: "passed" should read --is passed--.

Signed and Sealed this

Twenty-first Day of August, 2007

JON W. DUDAS
*Director of the United States Patent and Trademark Office*